United States Patent [19]

Bucy et al.

[11] 4,039,350

[45] Aug. 2, 1977

[54] INDUSTRIAL CLEANING SYSTEM

[75] Inventors: Harry S. Bucy, Sioux Falls; John F. Finger, Beresford, both of S. Dak.

[73] Assignee: Sioux Steam Cleaner Corporation, Beresford, S. Dak.

[21] Appl. No.: 663,674

[22] Filed: Mar. 4, 1976

[51] Int. Cl.[2] ..... B08B 9/00

[52] U.S. Cl. ..... 134/22 R; 134/10; 134/26; 134/102; 134/141; 134/152; 134/170

[58] Field of Search ..... 134/22 R, 29, 30, 10, 134/26, 95, 102, 103, 115 R, 134, 141, 143, 152, 153, 166 R, 169 R, 170, 171, 57 DL, 58 DL, 200; 21/93, 97

[56] References Cited

U.S. PATENT DOCUMENTS

| | | | |
|---|---|---|---|
| 3,270,754 | 9/1966 | Moelley et al. | 134/141 |
| 3,291,144 | 12/1966 | Diamond | 134/152 |
| 3,590,863 | 7/1971 | Faust et al. | 134/152 |
| 3,664,355 | 5/1972 | Adams | 134/200 |
| 3,801,371 | 4/1974 | Martin | 134/200 |
| 3,921,651 | 11/1975 | Weihe | 134/152 |

*Primary Examiner*—Robert L. Lindsay, Jr.
*Assistant Examiner*—George C. Yeung
*Attorney, Agent, or Firm*—Merchant, Gould, Smith, Edell, Welter & Schmidt

[57] ABSTRACT

An industrial cleaning system comprising a method and apparatus for substantially inverting a container to be cleaned into a washing space, temporarily enclosing the space, discharging cleaning fluids into and onto the container in a predetermined cycle of steps, removing the enclosure, and restoring the container to its initial position in cleaned, dryed, sterile condition.

9 Claims, 5 Drawing Figures

INDUSTRIAL CLEANING SYSTEM

BACKGROUND OF THE INVENTION

This invention relates to the field of industrial cleaning, and particularly to a method and means for cleaning containers used in the food industry. In such applications it is very important that all traces of residual matter, including biological organisms, be removed from a container intended for reuse. As is well known, ordinary immersion washing procedures are imperfect in this respect, particularly where the containers to be cleaned have corners, edges, or joints where undesired matter tends to collect.

The particular containers which this invention is especially designed to clean are called "fish boxes". They are used to receive tuna fish off the ship, for freezing and transportation from shipside to cold storage at the entrance to the tuna packing plant. The boxes are rectangular and quite large: since they are of metal they weigh several hundred pounds.

When needed for processing, the fish are thawed with warm water and removed from the boxes, which then contain residues of fish oil, fish skin sea water, and the foam that develops as the fish begin to thaw. It is necessary to clean and sterilize the boxes for reuse. Washing procedures involving submersion in cleaning liquid are not practical with such large objects, and also tend to perform imperfect cleaning along the edges and corners of the boxes.

SUMMARY OF THE INVENTION

We have invented a cleaning system which obviates immersion of the boxes, cleans them perfectly and sterilizes them, and handles the boxes mechanically without human intervention. According to our invention a box to be cleaned is simply placed on a loading frame whereafter the box is substantially inverted into a washing space, the space is enclosed to confine cleaning liquids to be used, and cleaning fluids are discharged into the box and over in a predetermined sequence of steps ending with a steam discharge which sterilizes and raises the temperature of the box, so that when the enclosure is removed and the box returns to its normal position it is dry, clean, and sterile.

Various advantages and features of novelty which characterize our invention are pointed out with a particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

DESCRIPTION OF THE PREFERRED EMBODIMENT

Figures 1, 2:
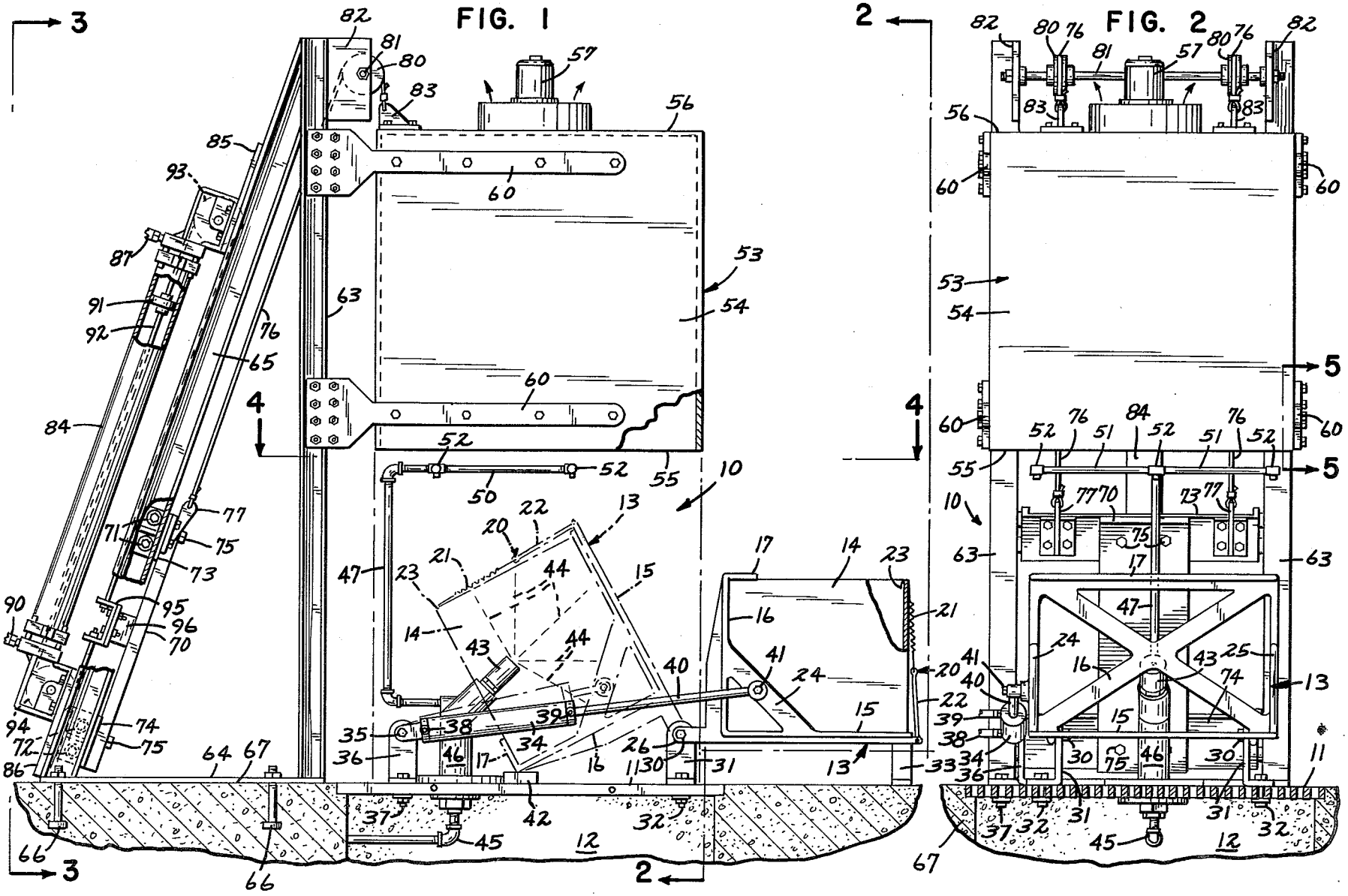
FIG. 1 is a front elevation of the apparatus used in our cleaning system.
FIG. 2 is a elevation viewed from the line 2—2 of FIG. 1; parts being omitted for clarity of illustration
Figure 4:
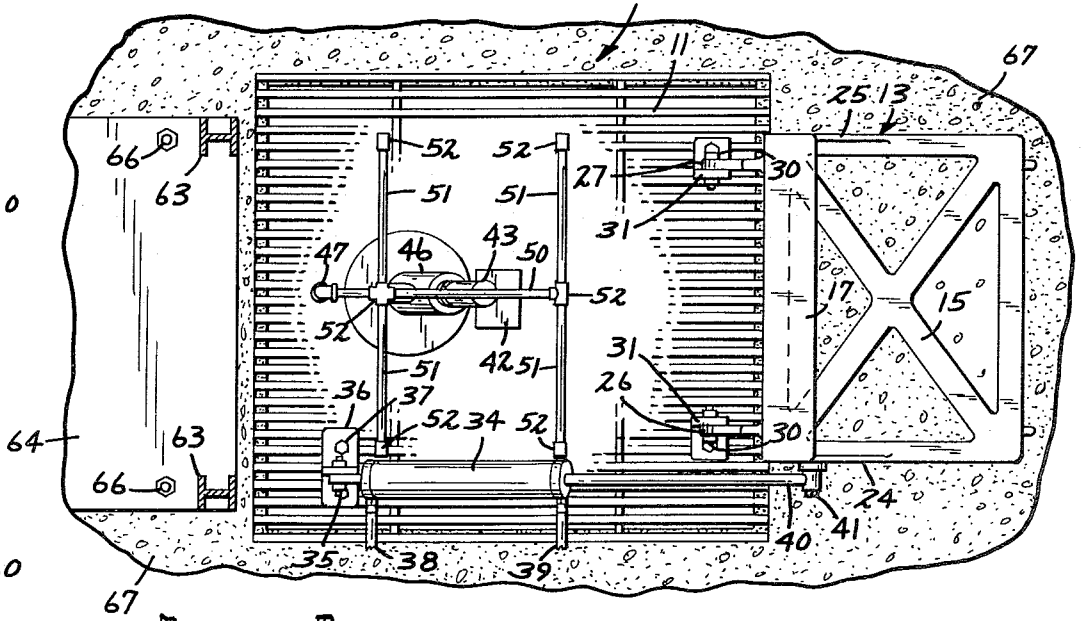
FIG. 4 is a fragmentary sectional plan view along the line 4—4 of FIG. 1, certain parts being omitted for clarity of illustration.
Figure 5:
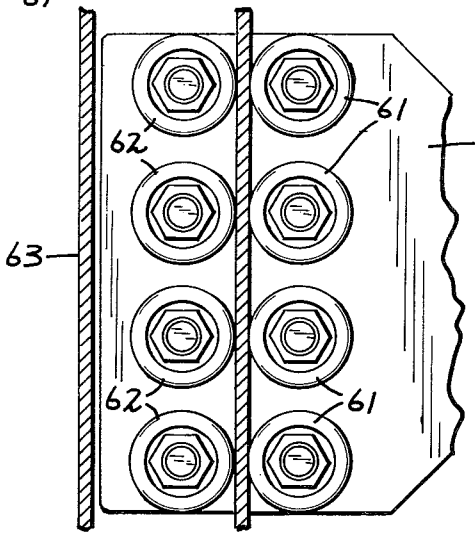
FIG. 5 is a fragmentary sectional view along the line 5—5 of FIG. 2.
Figure 3:
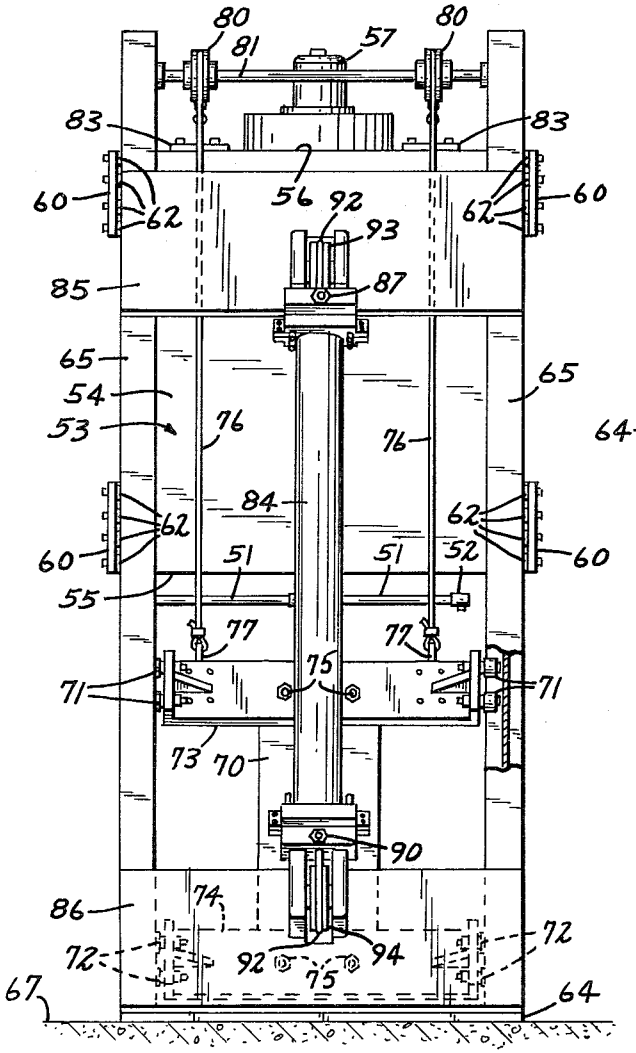
FIG. 3 is an elevation view from the line 3—3 of FIG. 1.

Our apparatus includes a washing space suggested by the reference numeral 10. The floor 11 of this space is a metal grid work over a sump 12 to receive liquids discharged in the washing process. A loading frame 13 sized to receive the box 14 to be cleaned has an open work bottom 15 and an open work side wall 16 with a ledge 17 turned back to engage the top rim of the box. Quick releasable means 20 are provided to retain the box in position on the frame in cooperation with ledge 17: one such means may comprise a tension spring 21 of suitable dimensions connected at one end to an arm 22 pivoted to frame bottom 15, and provided at the other end with a hook 23 for fitting over the rim of the box.

Bottom 15 and side 16 are connected by a pair of diagonal braces 24, 25, and bottom 15 is extended to provide a pair of ears 26, 27. Pivot pins 30 pass through ears 26, and 27 and through a pair of mounting brackets 31 secured to floor 11 at 32. Frame 13 is supported above the floor level by brackets 31 and a suitable pedestal 33.

A fluid motor 34 is pivotally connected at 35 to a bracket 36 secured to floor 11 at 37. Fluid connections to motor 34 are at 38 and 39. The actuator 40 of motor 34 is pivotally connected at 41 to brace 24. When motor 34 is actuated, frame 13 and the box 14 thereon may be displaced from the solid line position in FIG. 1 to the dotted line position, in which the box is substantially inverted, and the edge of ledge 17 rests on a contact block 42.

A liquid discharge nozzle 43 is mounted on floor 11 to be located within the box in its inverted position, and to direct its discharge in a generally upward direction. That discharge is not a narrow stream, but substantially a hemisphere, as suggested at 44. Fluid for discharge is supplied to nozzle 43 through a conduit 45 and a manifold 46. Also connected to manifold 46 through conduits 46 and 50 are a plurality of pipes 51 having spray heads 52 at their ends for directing fluid downwardly upon the outer surface of the inverted box and the frame that holds it. Members 43 and 45–52 are contained within space 10.

A canopy 53 is provided to confine the liquids discharged into the washing space 10. It comprises an inverted rectangular casing 54 with an open bottom 55 and a closed top 56. A fan 57 or other suitable device is mounted in an opening in top 56 to draw vapors out of the casing and discharge them into the ambient air. Arms 60 secured to casing 54 carry spaced rollers 61, 62 at their ends for guiding the casing along a vertical track comprising a pair of spaced H-beams 63 secured to a common base plate 64 and braced by a pair of diagonal H-beams 65 also secured to base plate 64. The assembly of members 63, 64 and 65 is secured in place by suitable fasteners 66 imbedded in a concrete floor 67, for example.

A counterweight 70 is arranged to ride on rollers 71, 72 running on the flanges of beams 65 and carried at the ends of cross members 73, 74 secured to the counterweight at 75. Cables 76 are secured t cross member 73 at ears 77 and pass over pulleys 80 carried by a shaft 81 mounted in brackets 82 carried by beams 63. The other ends of cables 76 are secured to canopy 53 at brackets 83. The mass of counterweight 70, cross members 73, 74 and so forth is such as to substantially balance the weight of canopy 53, so that the latter will remain at any position along its vertical track.

In the upper position of canopy 53 it is out of the path of frame 13 and box 14 as they are inverted into the wahing space, and the length of conduit 47 is also chosen to prevent interference between the frame and box and members 50, 51 and 52. When canopy 53 is lowered it encloses nozzle 43, spray heads 52, frame 13, and box 14 and the associated elements so that liquid supplied through conduit 45 is confined and drops through floor 11 to sump 12 for disposition or recirculation.

Movement of canopy 53 is brought about by a second fluid motor 84 mounted on cross plates 85 and 86 to extend parallel to beams 65. Fluid connections are made to motor 84 at 87 and 90. The piston 91 of motor 84 is connected to a cable 92 which passes around upper and lower pulleys 93 and 94 and has its ends secured to a bracket 95 carried by counterweight 70 as at 96.

OPERATION

In use a box 14 to be cleaned is placed on bottom 15 of frame 13 with its rim under ledge 17 and secured in position by means 20. Motor 34 is now operated to retract its actuator 40, pivoting the box about pivot points 30 into position in which ledge 17 contacts block 42. In this position of box 14 nozzle 43 extends within the box. Next, motor 84 is energized to move piston 91 downwardly, raising counterweight 70 along beams 65 and hence allowing canopy 53 to descend until it encloses washing space 10, including spray heads 52, nozzle 43, frame 13, box 14, and motor 34. Fan 57 is set into operation. The washing procedure can now be initiated.

In view of the particular undesired residues found to exist in the particular containers specified, the washing procedure has been set up as a series of steps taken in sequence, as follows:

1. a cold water rinse to remove proteins;
2. a high pressure detergent spray to dissolve grease;
3. a high volume mild caustic wash to remove all particles;
4. a hot water rinse to remove the cleaning chemical; and
5. steam cleaning to sterilize and dry the box.

Step number two may be accomplished with fluid at a temperature of 135° F, a pressure of 500 psig, and a flow of 360 gph. Step number three may be accomplished with fluid at a temperature of 140° F, a pressure of 80 psig, and a flow of 300 gpm. Step number four can be carried on with water at a temperature of 140° F to 212° F, depending on the caustic used. Step number five may be acccomplished with steam at 250° F to 325° F and a pressure of 100 psig, at a rate of 120 gph. While this sequence of cleaning steps could be performed automatically, the time intervals are such that manual operation of control valves is quite feasible.

The fluid reaching sump 12 during steps one, two, four and five may simply be discarded. Step number three may involve recirculating fluid reaching the pump for the period of the treating step, after which it too can be discarded.

The temperature rise in the box and frame during the last two steps ensure that the canopy is raised and the box returned to its initial position no liquid remains to flow into any crevices in the box or between the box and the frame. A suitable temporary cover may be applied and the clean box removed from the frame for reuse.

From the foregoing it will be evident that we have invented a new and improved industrial cleaning system, comprising a method and means for cleaning open top containers without requiring them to be immersed in cleaning fluid. In the practice of the invention a container to be cleaned is mounted, substantially inverted into a washing space, temporarily enclosed, treated inside and outside with fluid in a series of cleaning steps which end with a clean dry and sterile box, from which the enclosure can be removed and which can be returned to its initial position and stored as a clean, sterile container ready for reuse.

While the invention has been described in use of a rectangular container, known as a fish box, it is well adapted for use with large containers of other shapes and sizes, and contaminated with other kinds of undesirable matter.

Numerous characteristics and advantages of our invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of terms in which the appended claims are expressed.

We claim:

1. The method of cleaning an open top container without immersing it in a body of liquid which comprises the steps of:

1. positioning the container in a holding frame;
2. pivoting the frame and container to substantially invert the container into a washing space;
3. enclosing the washing space to confine fluids to discharge therein;
4. discharging a succession of cleaning fluids upwardly and into and downwardly onto the container; and
5. drying the container by heat before returning it to its normal position.

2. The method of claim 1 in which the succession of cleaning fluids is discharged in predetermined sequence of steps including a cold water rinse, a high pressure detergent spray, a high volume mild caustic wash, a hot rinse, and a steam sterilization, at least one of said steps including recirculation of the cleaning fluid.

3. Apparatus for cleaning an open top container comprising, in combination:

means for receiving and holding a container to be cleaned;

reversible means for substantially inverting a container held by the first named means into a washing space;

nozzle means in said space for directing fluids into the inverted container;

spray means in said space for discharging fluid upon the outer surface of the inverted container;

a canopy sized to envelop said washing space;

means mounting said canopy for movement between a lower position, in which it substantially encloses said washing space, and an upper position, in which it is out of the path of the container during the inversion thereof;

means reversibly energizable to cause said movement of said canopy;

and, means for supplying selected cleaning fluids to said nozzle means and said spray means.

4. The apparatus of claim 3, together with sump means below said washing space for receiving liquids discharged from said nozzle means and said spray means;

and means for recirculating liquid from said sump means to provide said nozzle means and said spray means.

5. In combination:

a first vertical track;

a canopy mounted for movement along said track between an upper position and a lower position in which defines a washing space;

a second track;

a counterweight movable along said second track;

means including a pulley at the top of said vertical track connecting said counterweight in balancing relation to said canopy;

motor means for causing means movement of said counterweight along said second track, to be accompanied by movement of said canopy along said vertical track;

nozzle means directed generally upwardly in said washing space;

downwardly directed spray means in said washing space;

frame means for receiving and retaining a container having an open top;

means including further motor means for pivoting the frame means into said washing space so as to substantially invert said container over said nozzle means and under said spray means;

and means supplying selected cleaning fluids to said nozzle means and said spray means in a predetermined cycle of steps.

6. The apparatus of claim 5 in which the last named means includes a sump beneath said washing space and means recirculating liquid from said sump to said nozzle and said spray means.

7. The apparatus of claim 6 in which the top of said canopy includes means discharging vapors from said washing space.

8. The apparatus of claim 6 together with a gridwork platform defining the bottom of said washing space and stop means for supporting said frame means in the inverted position of said container.

9. In an industrial cleaning system, in combination:

means for holding a container to be cleaned; reversible means coupled to said holding means for introducing the container into a washing space while substantially inverting said container;

a canopy sized to enclose said washing space;

reversible means moving said canopy into enclosing relation with said washing space;

and means discharging cleaning fluids into and upon said inverted container in said washing space in a predetermined sequence of steps which leaves the container clean, sterile, and above ambient temperature for rapid drying.

* * * * *

UNITED STATES PATENT AND TRADEMARK OFFICE

CERTIFICATE OF CORRECTION

PATENT NO. : 4,039,350

DATED : August 2, 1977

INVENTOR(S) : Harry S. Bucy and John F. Finger

It is certified that error appears in the above-identified patent and that said Letters Patent are hereby corrected as shown below:

Column 1, line 42, after "over, insert --the box--.

Column 1, line 48, after "with" delete --a--.

Column 2, line 41, change "46" to --47--.

Column 2, line 63, "t" should be --to--.

Column 3, line 5, "wahing" should be --washing--.

Column 3, line 26, after "into" insert --the--

Column 3, line 55, after "intervals" insert --involved--.

Column 3, line 63, after "that" insert --when--.

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*